US011248811B2

(12) United States Patent
Yang et al.

(10) Patent No.: US 11,248,811 B2
(45) Date of Patent: Feb. 15, 2022

(54) HUMIDIFIER WITH WATERPROOF ARRANGEMENT

(71) Applicant: Shenzhen Chenbei Technology Co., Ltd., Shenzhen (CN)

(72) Inventors: Lin Yang, Shenzhen (CN); Hai Yang, Shenzhen (CN)

( * ) Notice: Subject to any disclaimer, the term of this patent is extended or adjusted under 35 U.S.C. 154(b) by 51 days.

(21) Appl. No.: 16/813,461

(22) Filed: Mar. 9, 2020

(65) Prior Publication Data

US 2020/0284451 A1 Sep. 10, 2020

(30) Foreign Application Priority Data

Mar. 8, 2019 (CN) ..... 201910174704.3

(51) Int. Cl.
*F24F 6/02* (2006.01)
*F24F 6/00* (2006.01)

(52) U.S. Cl.
CPC ..... *F24F 6/02* (2013.01); *F24F 2006/008* (2013.01)

(58) Field of Classification Search
CPC ..... F24F 11/0008; F24F 6/00; F24F 13/06; F24F 13/20; F24F 2006/008; F24F 6/12; F24F 13/00; F24F 6/02; F24F 13/32
See application file for complete search history.

(56) References Cited

U.S. PATENT DOCUMENTS 5,859,952 A * 1/1999 Levine ..... F24F 1/02 392/405

FOREIGN PATENT DOCUMENTS

| | | |
|---|---|---|
| CN | 209877257 | * 12/2019 |
| JP | S5996518 | * 6/1984 |
| JP | 2016044925 | * 4/2016 |

OTHER PUBLICATIONS

"Printed circuit board" Wikipedia published Mar. 16, 2015 accessed at <https://en.wikipedia.org/w/index.php?title=Printed_circuit_board&oldid=651684327> (Year: 2015).*
EPO translation of CN 209877257 (Year: 2019).*
EPO translation of JP2016044925 (Year: 2016).*
Google translation of JPS5996518 (Year: 1984).*

* cited by examiner

*Primary Examiner* — Stephen Hobson
(74) *Attorney, Agent, or Firm* — Tsz Lung Yeung

(57) ABSTRACT

A humidifier includes a base, a water tank, a water vaporizer, a fan, a printed circuit board, and a waterproof arrangement. The base has a receiving cavity and a vapor discharge outlet. The water tank is detachably attached on the base, and has a vapor discharge channel communicated with the vapor discharge outlet. The waterproof arrangement includes a water blocking assembly including a main blocking member and an actuating member. When the water tank is attached on the base, the water blocking assembly is driven to move away from the vapor discharge outlet. When the water tank is to detached from the base, the actuating member is driven to drive the water blocking assembly to fittedly cover the vapor discharge outlet so as to prevent water from entering the vapor discharge outlet.

17 Claims, 9 Drawing Sheets

HUMIDIFIER WITH WATERPROOF ARRANGEMENT

CROSS REFERENCE TO RELATED APPLICATION

This is a non-provisional application which claims priority to a Chinese patent application having application number of CN 201910174704.3, and filing date of Mar. 8, 2019, the entire contents of which is hereby incorporated by reference.

BACKGROUND OF THE PRESENT INVENTION

Field of Invention

The present invention relates to a humidifier, and more particularly to a humidifier comprising a waterproof arrangement which is capable of preventing water from contacting electronic components of the humidifier.

Description of Related Arts

With the improvement of living standards around the world and particularly developed countries, the requirement for indoor air quality is becoming higher and higher. People not only require indoor air temperature to be within a suitable range, but also require a suitable range of indoor air humidity. As a result, various kinds of humidifiers have been made available, such as ultrasonic humidifiers, electric humidifiers, and the likes. These conventional humidifiers may release water vapor in the air and therefore increase the general humidity in the indoor space where the humidifier is located.

A conventional humidifier usually comprises a main housing having a water tank, a vaporizer supported in the main housing, and a fan also supported in the main housing. The water tank should be filled with a predetermined amount of water. When the humidifier is turned on, the water in the water tank is vaporized by the vaporizer and the water vapor is blown to a designated indoor space by the fan.

A major disadvantage of conventional humidifiers such as the one described above is that when the humidifier has been used for a certain period of time, it needs to be cleaned because dirt may deposit on various parts of the humidifier. However, when cleaning the humidifier, one needs to be very careful because water may pass through air or vapor outlet of the humidifier and enter the chamber where all the electronic components are located. If water enters the chamber (usually inside the main housing) where all the electronic components are located, the humidifier may no longer work properly. In more serious cases, the water may cause short circuits and electric fire. This poses a great safety risk to users of conventional humidifiers.

As a result, there is a need to develop a humidifier which is capable of preventing water from contacting electronic components of the humidifier.

SUMMARY OF THE PRESENT INVENTION

Certain variations of the present invention provide a humidifier comprising a waterproof arrangement which is capable of preventing water from contacting electronic components of the humidifier.

Certain variations of the present invention provide a humidifier comprising a waterproof arrangement which is capable of automatically blocking water from entering an air outlet when a water tank is detached from a base housing.

Certain variations of the present invention provide a humidifier comprising a waterproof arrangement which is capable of automatically unblocking a vapor discharge outlet when a water tank is attached on the base housing.

Certain variations of the present invention provide a humidifier comprising a waterproof arrangement which provides dual protection to electronic components of the humidifier.

In one aspect of the present invention, it provides a humidifier, comprising:

a base comprising a base housing having a receiving cavity, an engaging member provided in the receiving cavity, and a vapor discharge outlet;

a water tank which is detachably attached on the base, and comprises a tank body having a storage cavity for storing a predetermined amount of water, and a vapor discharge channel communicated with the vapor discharge outlet, the water tank further comprising a water dispensing mechanism provided on the tank body and arranged to selectively engage with the engaging member of the base;

a water vaporizer provided in the base housing;

a fan provided in the base housing;

a printed circuit board having a control circuitry implemented thereon; and a waterproof arrangement, which comprises a water blocking assembly movably provided in the base housing to selectively cover the vapor discharge outlet of the base housing, the water blocking assembly comprising:

a main blocking member; and an actuating member extended from the main blocking member, wherein when the water tank is attached on the base, the actuating member is driven to drive the water blocking assembly to move away from the vapor discharge outlet so as to allow the vapor discharge outlet to communicate with the vapor discharge channel of the tank body, wherein when the water tank is detached from the base, the actuating member is driven to drive the water blocking assembly to fittedly cover the vapor discharge outlet so as to prevent water from entering the vapor discharge outlet.

This summary presented above is provided merely to introduce certain concepts and not to identify any key or essential features of the claimed subject matter.

DETAILED DESCRIPTION OF THE PREFERRED EMBODIMENT

Figure 1:
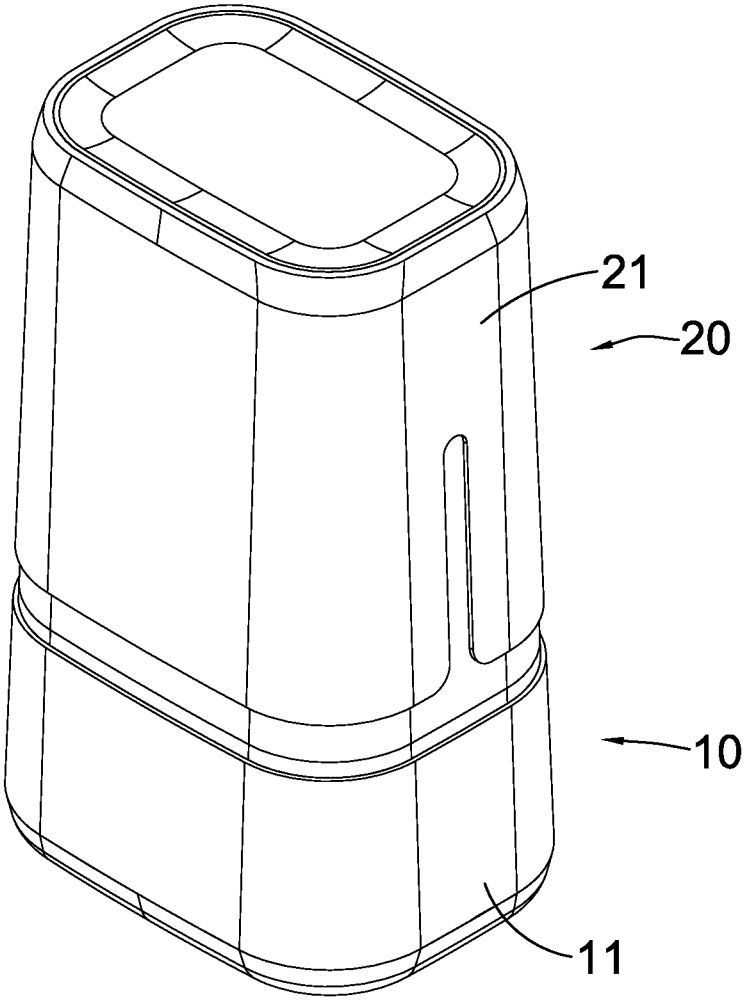
FIG. 1 is a perspective view of a humidifier according to a preferred embodiment of the present invention.
Figure 2:
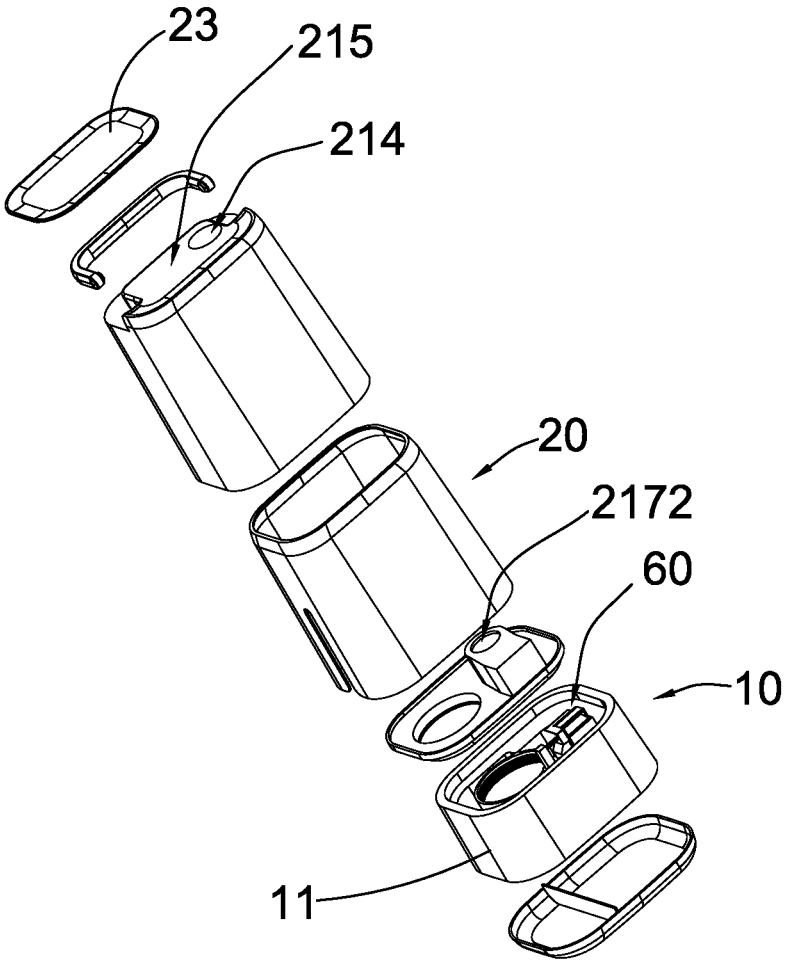
FIG. 2 is an exploded perspective view of the humidifier according to the preferred embodiment of the present invention.

The following detailed description of the preferred embodiment is the preferred mode of carrying out the invention. The description is not to be taken in any limiting sense. It is presented for the purpose of illustrating the general principles of the present invention.

It should be appreciated that the terms "install", "connect", "couple", and "mount" in the following description refer to the connecting relationship in the accompanying drawings for easy understanding of the present invention. For example, the connection can refer to permanent connection or detachable connection. Furthermore, "connected" may also mean direct connection or indirect connection, or connection through other auxiliary components. Therefore, the above terms should not be an actual connection limitation of the elements of the present invention.

It should be appreciated that the terms "length", "width", "top", "bottom", "front", "rear", "left", "right", vertical", "horizontal", "upper", "lower", "exterior", and "interior" in the following description refer to the orientation or positioning relationship in the accompanying drawings for easy understanding of the present invention without limiting the actual location or orientation of the present invention. Therefore, the above terms should not be an actual location limitation of the elements of the present invention.

It should be appreciated that the terms "first", "second", "one", "a", and "an" in the following description refer to "at least one" or "one or more" in the embodiment. In particular, the term "a" in one embodiment may refer to "one" while in another embodiment may refer to "more than one". Therefore, the above terms should not be an actual numerical limitation of the elements of the present invention.

Referring to FIG. 1 to FIG. 10 of the drawings, a humidifier according to a preferred embodiment of the present invention is illustrated. Broadly, the humidifier may comprise a base 10, a water tank 20, a water vaporizer 30, a fan 40, a printed circuit board (PCB 50), and a waterproof arrangement 60. The humidifier may be arranged to generate water vapor or water vapor to a designated indoor space.

The base 10 may comprise a base housing 11 having a receiving cavity 111, an engaging member 12 provided in the receiving cavity 111, and a vapor discharge outlet 13.

The water tank 20 may be detachably attached on the base 10, and may comprise a tank body 21 having a storage cavity 211 for storing a predetermined amount of water, and a vapor discharge channel 212 communicated with the vapor discharge outlet 13 of the base 10. The water tank 20 may further comprise a water dispensing mechanism 22 provided on the tank body 21 and arranged to selectively engage with the engaging member 12 of the base 10.

The water vaporizer 30, the fan 40 and the PCB 50 may be provided in the base housing 11. Moreover, the PCB 50 may have a control circuitry 51 implemented thereon for controlling an operation of the humidifier. The water vaporizer 30 and the fan 40 may be electrically connected to the PCB 50.

The waterproof arrangement 60 may comprise a water blocking assembly 61 movably provided in the base housing 11 to selectively cover the vapor discharge outlet 13 of the base housing 11. The water blocking assembly 61 may comprise a main blocking member 611 and an actuating member 612 extended from the main blocking member 611. When the water tank 20 is attached on the base 10, the actuating member 612 may be driven to drive the entire water blocking assembly 61 to move away from the vapor discharge outlet 13 so as to allow the vapor discharge outlet 13 to communicate with the vapor discharge channel 212 of the tank body 21. When the water tank 20 is detached from the base 10, the actuating member 612 may be driven to drive the entire water blocking assembly 61 to fittedly cover the vapor discharge outlet 13 so as to prevent water from entering the vapor discharge outlet 13.

Figure 3:
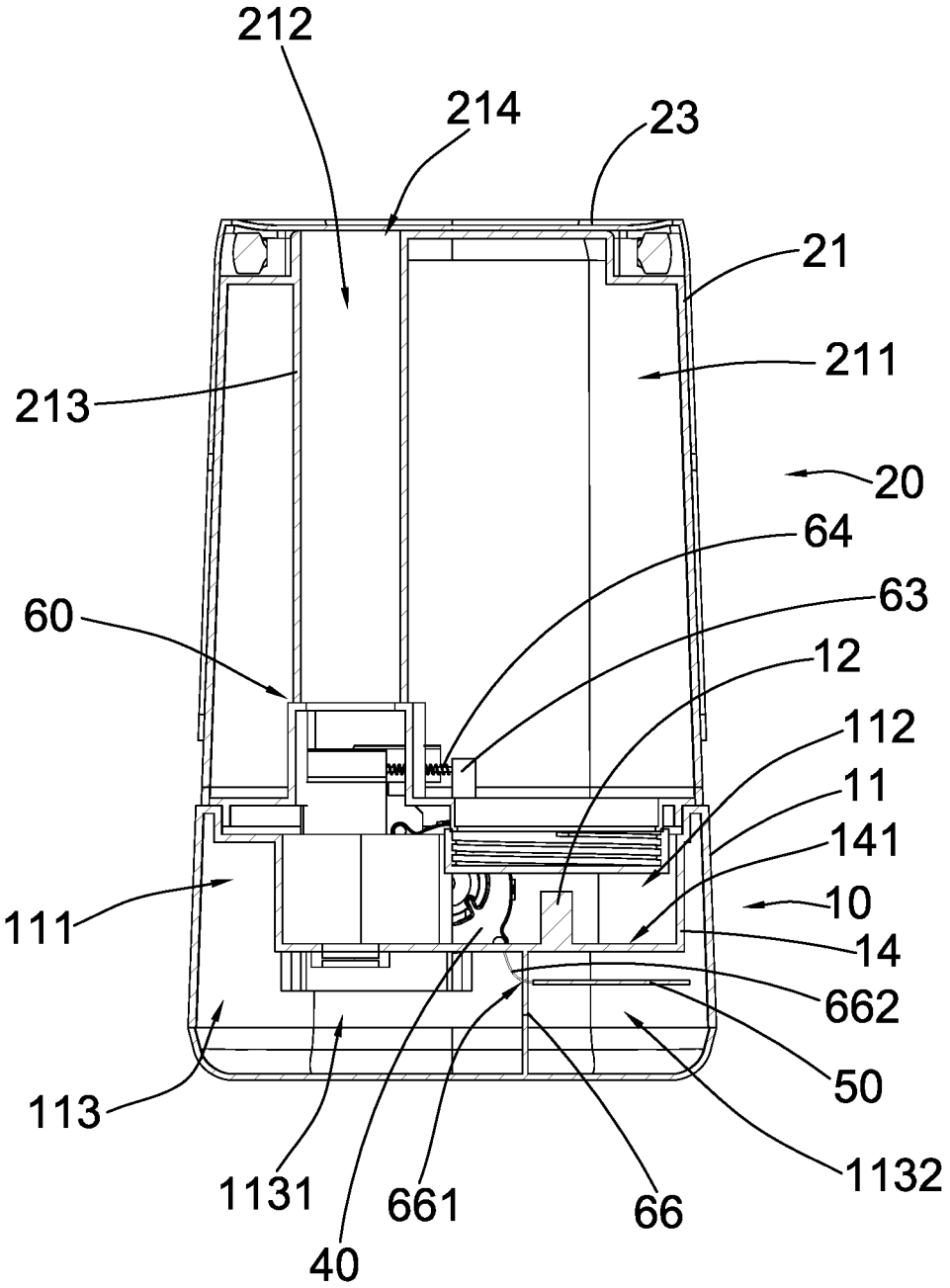
FIG. 3 is sectional side view of the humidifier according to the preferred embodiment of the present invention.
Figure 4:
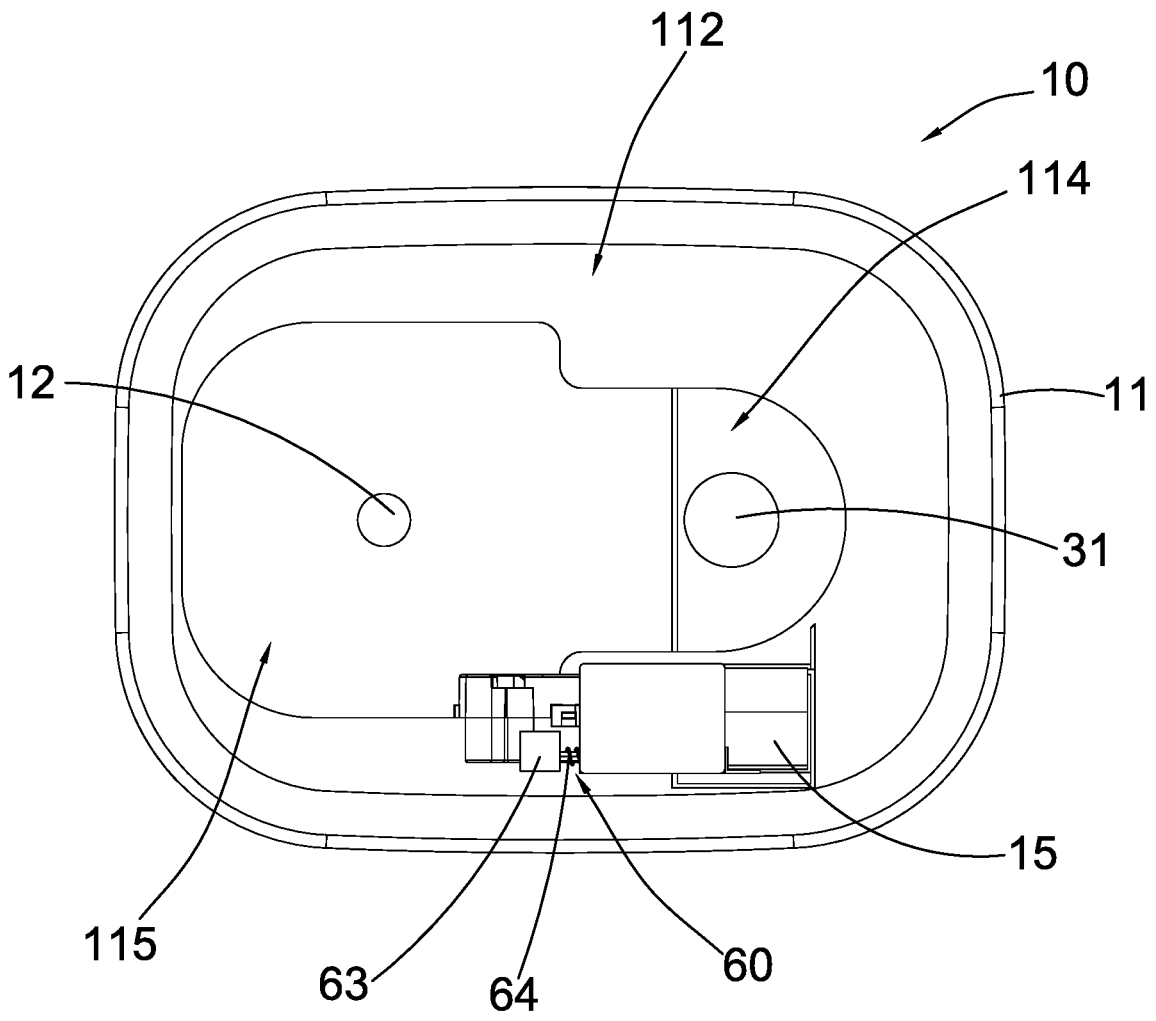
FIG. 4 is a top view of the base of the humidifier according to the preferred embodiment of the present invention.

According to the preferred embodiment of the present invention, the base 10 may further comprise a supporting platform 14 mounted in the receiving cavity 111 of the base housing 11 to divide the receiving cavity 111 into a first supporting compartment 112 and a second supporting compartment 113 as separated by the supporting platform 14. The engaging member 12 may extend in the first supporting compartment 112 for selectively engaging with the water dispensing mechanism 22 of the water tank 20. As shown in FIG. 3 of the drawings, the first supporting compartment 112 and the second supporting compartment 113 may be physically separated by the supporting platform 14. Depending on the shape of the supporting platform 14, the second supporting compartment 113 may be arranged to surround or embed the first supporting compartment 112. Other configurations are also possible.

On the other hand, the water tank 20 may be supported on top of the base 10 for supplying water to the water vaporizer 30. As shown in FIG. 3 of the drawings, the tank body 21 may have the storage cavity 211 for storing a predetermined amount of water. The tank body 21 may further have a guiding tube 213 formed in the storage cavity 211 wherein the vapor discharge channel 212 may be formed in a space within the guiding tube 213. The vapor discharge channel 212 may be utilized to provide a channel for allowing vaporized water (water vapor) to be discharged out of the humidifier. Thus, the vapor discharge channel 212 may extend along a longitudinal or vertical direction of the water tank 20. The vapor discharge channel 212 and the remaining portion of the storage cavity 211 may be physically separated by a surrounding wall of the guiding tube 213.

Figure 8:
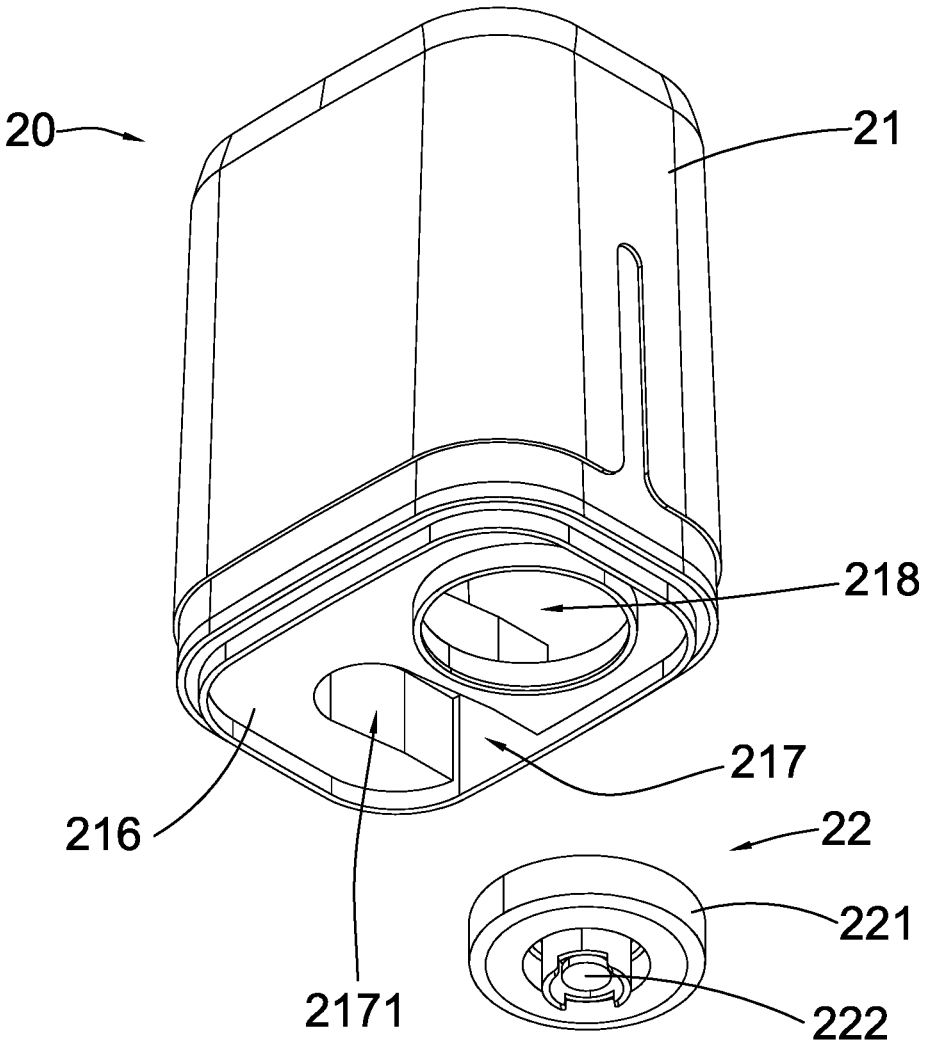
FIG. 8 is a schematic diagram of a water tank of the humidifier according to the preferred embodiment of the present invention, illustrating a bottom portion of the tank body.

The tank body 21 may further have a vapor discharge opening 214 formed on a top surface 215 thereof, wherein the vapor discharge opening 214 may be positioned to correspond to the vapor discharge channel 212 so that the vapor generated by the water vaporizer 30 may be discharged out of the humidifier through the vapor discharge opening 214. Furthermore, the water tank 20 may further comprise a tank cover 23 movably mounted on the tank body 21 for selectively covering the vapor discharge opening 214. In addition, as shown in FIG. 8 of the drawings, the tank body 21 may further have a bottom panel 216 which forms a bottom boundary of the storage cavity 211.

The water tank 20 may further comprise a water dispensing mechanism 22 provided on the bottom panel 216 of the tank body 21. Thus, the tank body 21 may further have a water discharge hole 218 formed on the bottom panel 216, wherein the water dispensing mechanism 22 may be provided on the bottom panel 216 to selectively control discharge of water from the storage cavity 211 through the water discharge hole 218. More specifically, the water dispensing mechanism 22 may comprise a controlling cap 221 and a sealing member 222 movably provided in the controlling cap 221. The controlling cap 221 may be detachably attached on the bottom panel 216 for selectively covering the water discharge hole 218. The sealing member 222 may be normally subject to an urging force exerted by a resilient element mounted in the controlling cap 221 for normally blocking the water discharge hole 218 when the controlling cap 221 is mounted on the bottom panel 216. The water discharge hole 218 and the sealing member 222 may be positioned to correspond to the engaging member 12 of the base 10 so that when the water tank 20 is attached on the base 10, the engaging member 12 may be arranged to push the sealing member 222 upwardly toward the top portion of the tank body 21 so as to open the water discharge hole 218 for releasing water from the storage cavity 211 to flow to the base housing 21. Note that the controlling cap 221 may be detached from the bottom panel 216 for allowing a user to discharge unused water from the storage cavity 211 or refill water therein.

The water vaporizer 30 may be provided in the first supporting compartment 112 of the base housing 11 and may be arranged to vaporize water supplied from the water tank 20 through a vaporizing head 31. Specifically, the water vaporizer 30 may be electrically connected to the PCB 50 so that the water vaporizer 30 may be driven to operate by the control circuitry 51. The fan 40 may also be provided in the first supporting compartment 112 in the vicinity of the water vaporizer 30 for blowing water vapor to flow into the vapor discharge channel 212. The fan 40 may also be electrically connected to the PCB 50 so that the control circuitry 51 may centrally control the water vaporizer 30 and the fan 40. The fan 40 may be embodied as having waterproof property so that it may be utilized in the base 10 in conjunction with the vaporizer 30.

The vapor discharge channel 212 may be positioned corresponding to the vapor discharge outlet 13 of the base 10 so that when the vapor discharge outlet 13 is opened, and the vaporizer 30 and the fan 40 are turned on, water vapor may be guided to pass through the vapor discharge outlet 13, the vapor discharge channel 212 and eventually discharged out of the humidifier through the vapor discharge opening 214.

Figure 5:
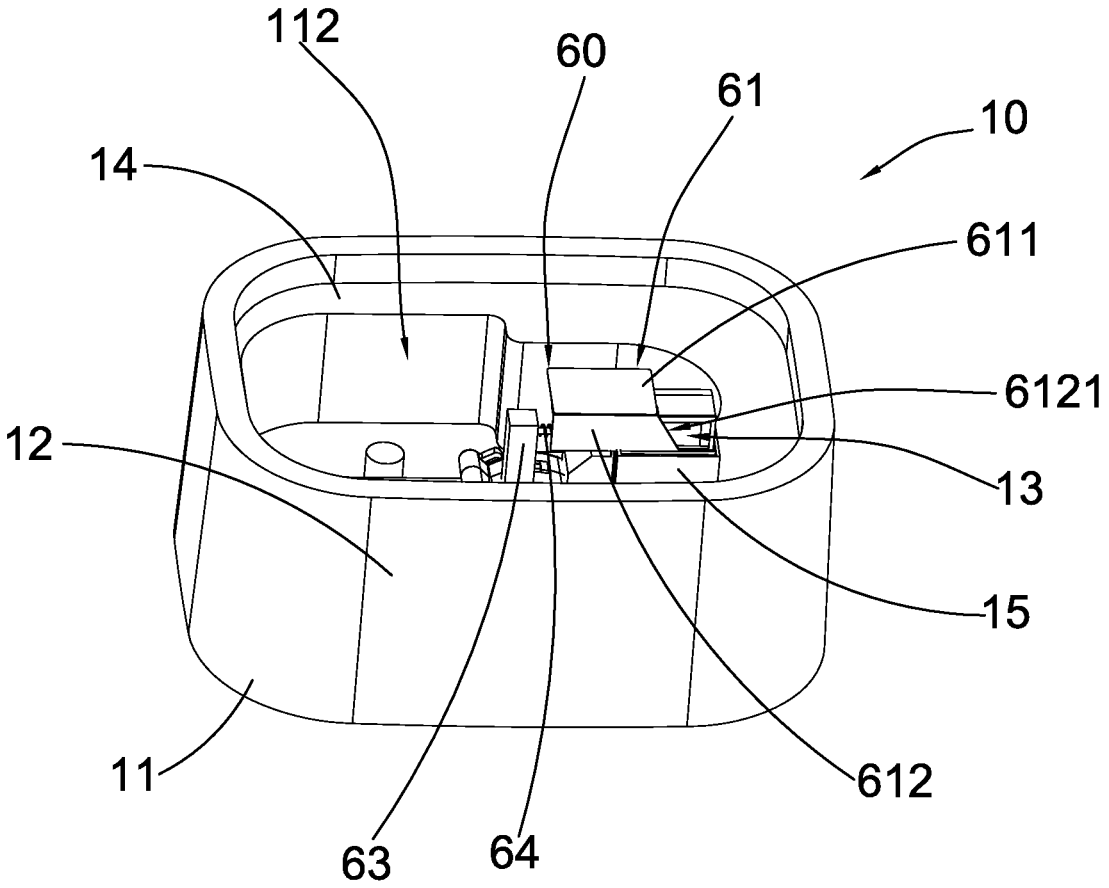
FIG. 5 is a rear perspective view of a base of the humidifier according to the preferred embodiment of the present invention.
Figure 6:
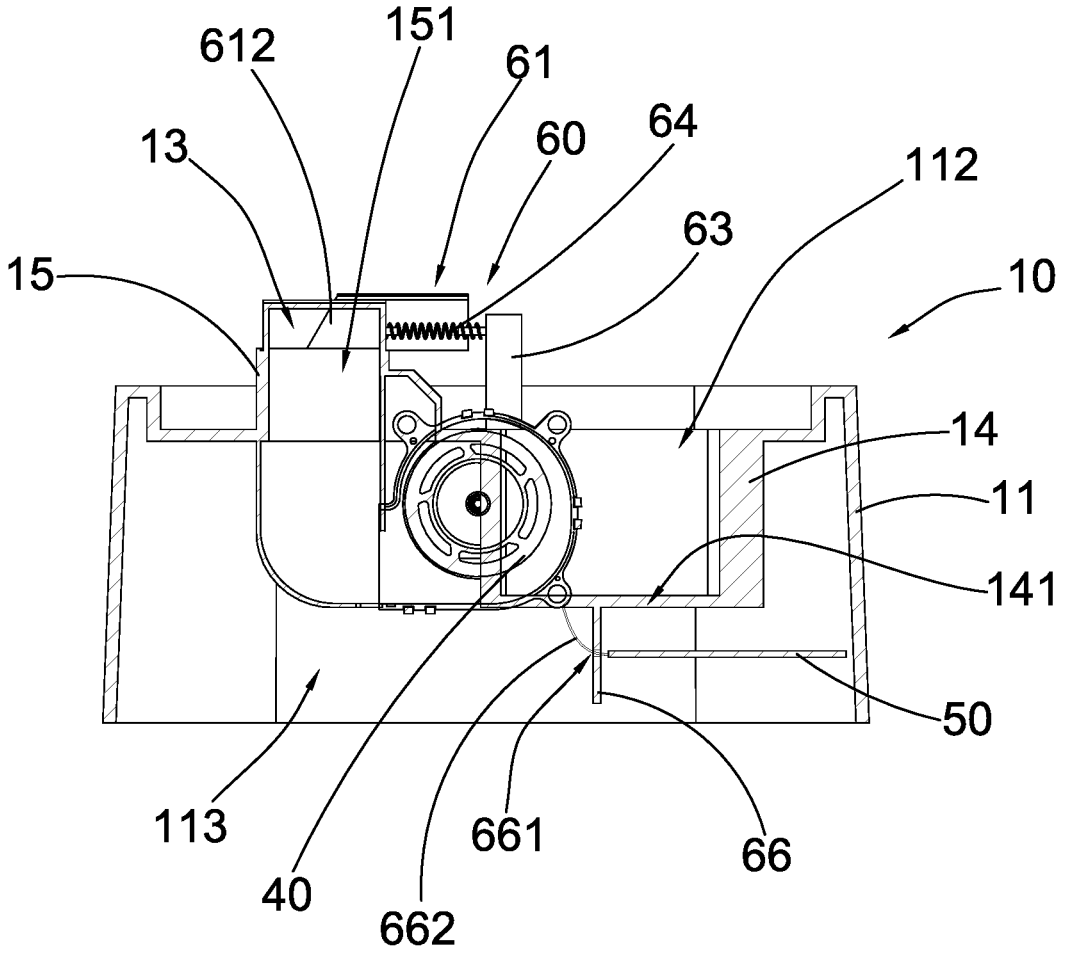
FIG. 6 is partial sectional front view of the base of the humidifier according to the preferred embodiment of the present invention.
Figure 7:
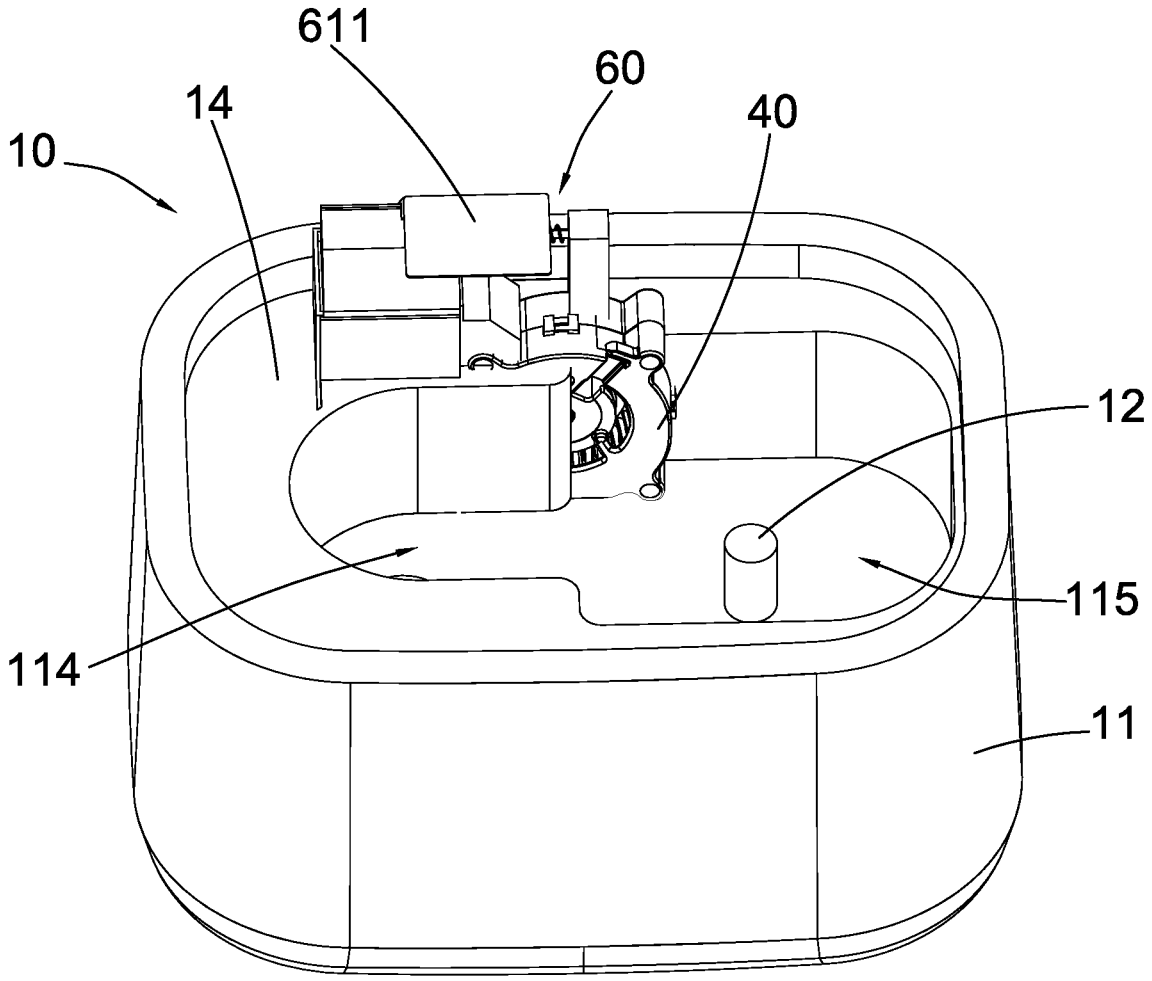
FIG. 7 is a front perspective view of the base of the humidifier according to the preferred embodiment of the present invention.

Referring to FIG. 5 to FIG. 7 of the drawings, the base housing 11 may further have a first water reservoir 114 and a second water reservoir 115 formed on the supporting platform 14 in the first supporting compartment 112. The first water reservoir 114 and the second water reservoir 115 may be arranged to store a predetermined amount of water coming from the water tank 20. The first water reservoir 114 and the second water reservoir 115 may communicate with each other. The vaporizing head 31 of the water vaporizer 30 may be provided in the first water reservoir 114 for vaporizing the water temporarily stored therein.

On the other hand, the second water reservoir 115 may communicate with the water tank 20 so that the water stored in the water tank 20 may be guided to enter the second water reservoir 115 when the water tank 20 is attached on the base 10. The water entering the second water reservoir 115 may be guided to enter the first water reservoir 114. The water in the water reservoir 114 may be vaporized by the water vaporizer 30 in the manner described above.

As shown in FIG. 5 of the drawings, the base 10 may further comprise a securing housing 15 extended on the supporting platform 14 in the first supporting compartment 112, wherein the vapor discharge outlet 13 may be formed as an opening of the securing housing 15. On the other hand, the waterproof arrangement 60 may be provided in the base housing 11 for selectively opening and closing the vapor discharge outlet 13. Accordingly, the water blocking assembly 61 may slidably engage with the securing housing 15 for selectively opening and closing the vapor discharge outlet 13. As shown in FIG. 6 of the drawings, the securing housing 15 may have a vapor passage channel 151 formed therein. The vapor passage channel 151 may communicate with the fan 40 and the water vaporizer 30 so as to constitute a channel for allowing water vapor to pass therethrough. Accordingly, the vapor discharge outlet 13 may be formed as an end opening of the vapor passage channel 151 which may also be the opening of the securing housing 15 as mentioned above.

In this preferred embodiment, the fan 40 may be supported near the water vaporizer 30 and communicate with the vapor passage channel 151 of the securing housing 15. The water vapor produced by the water vaporizer 30 may be guided to pass through the fan 40 and enter the vapor passage channel 151 which may then be blew by the fan 40 so as to guide the water vapor to flow toward the vapor discharge outlet 13 and eventually flow toward the vapor discharge channel 212 through the waterproof arrangement 60.

The waterproof arrangement 60 may further comprise a securing member 63 provided on the supporting platform 14, and a resilient element 64 mounted on the securing member 63 for normally exerting a biasing force against the water blocking assembly 61 so as to normally push the water blocking assembly 61 to block the vapor discharge outlet 13.

The water blocking assembly 61 may have a main blocking member 611 and an actuating member 612 extended from the main blocking member 611 while the waterproof arrangement 60 may further comprise a pushing member 65 provided on the bottom panel 216 of the tank body 21 at a position corresponding to the actuating member 612 of the water blocking assembly 61 so that when the water tank 20 is disposed on the base 10, the pushing member 65 may be arranged to push the actuating member 612 in such a manner to push the water blocking assembly 61 toward the securing member 63. When this occurs, the water blocking assembly 61 may be pushed to open the vapor discharge outlet 13 of the base 10, and water vapor or vapor may be allowed to pass through the vapor discharge outlet 13 and reach the vapor discharge channel 212.

Figure 9:
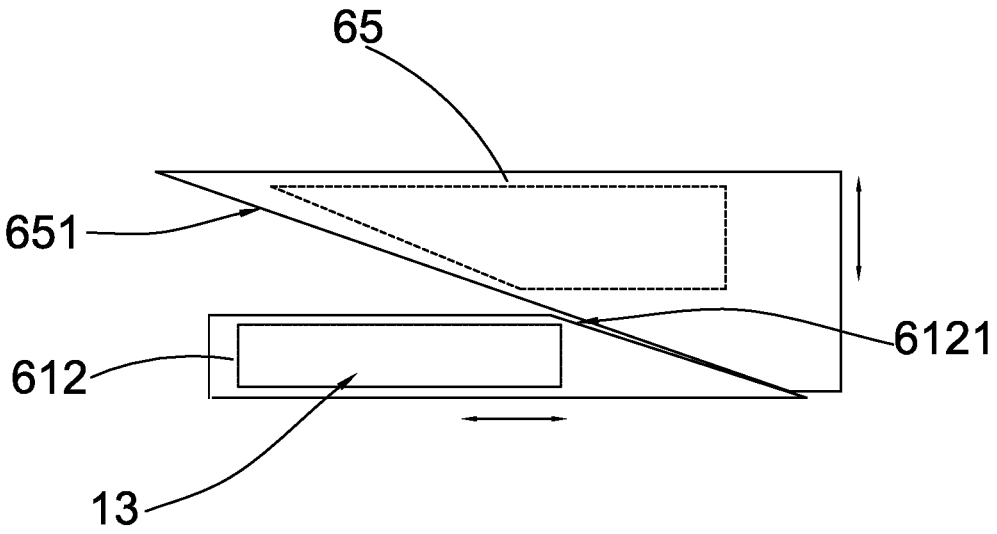
FIG. 9 is a schematic diagram of an interaction between a pushing member and a slanted surface of a waterproof arrangement according to the preferred embodiment of the present invention.
Figure 10:
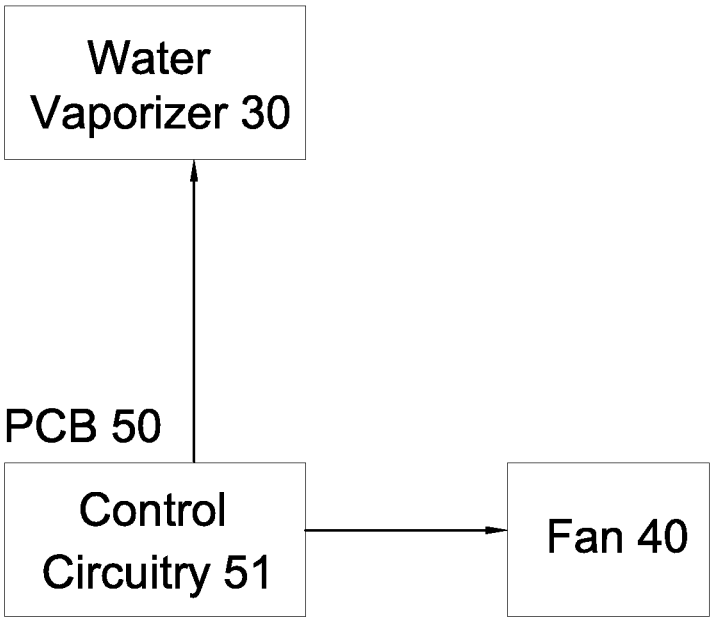
FIG. 10 is a block diagram illustrating electrical connection in the humidifier according to the preferred embodiment of the present invention.

As shown in FIG. 6 and FIG. 9 of the drawings, the actuating member 612 of the water blocking assembly 61 may be shaped such that a downward pushing action of the pushing member 65 may drive the actuating member 612 and the main blocking member 611 to move sidewardly with respect to the securing housing 15 so as to drive the entire water blocking assembly 61 to slide toward the securing member 63 for opening the vapor discharge outlet 13. In this preferred embodiment, the resilient element 64 may be configured as a compression spring and the pushing force toward the water blocking assembly 61 may be greater than the biasing force of the resilient element 64, so that the movement of the water blocking assembly 61 may be arranged to temporarily compress the resilient element 64 for keeping the vapor discharge outlet 13 opened. As shown in FIG. 7 of the drawings, the main blocking member 611 may be arranged to cover a top portion of the securing housing 15 while the actuating member 612 may be arranged to downwardly extend from the main blocking member 611 to cover the vapor discharge outlet 13.

The actuating member 612 of the water blocking assembly 61 may have a slanted surface 6121 for contacting with a pushing surface 651 (which may also be slanted) of the pushing member 65 in such a manner that when the pushing member 65 is driven to move downwardly with respect to the base housing 11, the actuating member 612 may be pushed to move sidewardly because of the engagement between slanted surface 6121 and the pushing surface 651.

When the water tank 20 is detached from the base 10, such as when the tank 20 needs cleaning, the pushing member 65 may be disengaged from the actuating member 612 of the water blocking assembly 61. Thus, the pushing force exerted on the water blocking assembly 61 may be released and the biasing force of the resilient element 64 may resume. The result is that the water blocking assembly 61 may be pushed to slide along the securing housing 15 and close the vapor discharge outlet 13 for preventing water from entering the base 10 through the vapor discharge outlet 13.

Referring to FIG. 3 and FIG. 6 of the drawings, the waterproof arrangement 60 may further comprise a protection panel 66 extended in the second supporting compartment 113 of the base 10 to divide the second supporting compartment 113 into a main section 1131 and a waterproof section 1132, wherein the PCB 50 may be accommodated in the waterproof section 1132 of the second supporting compartment 113. It is worth mentioning that the protection panel 66 may serve as an additional safeguard for preventing water from contacting the PCB 50. Water from outside the base 10 may first be blocked by the water blocking assembly 61 and then by the protection panel 66. As such, the humidifier of the present invention may ensure that the PCB 50 and the control circuitry 51 implemented thereon may be well protected from water when the base 10 needs to be cleaned.

The protection panel 66 may have at least one connecting hole 661 for allowing the PCB 50 to be electrically connected to the fan 40 and the water vaporizer 30 through at least one electrical wire 662 extending through the connecting hole 661. The number of connecting hole 661 may be made to be minimum so as to maximize waterproof performance of the protection panel 66.

On the other hand, the electrical components of the water vaporizer 30 may be supported in the main section 1131 of the second supporting compartment 113. The water vaporizer 30 may be arranged to vaporize water contained in the first supporting compartment 112 through the vaporizing head 31 supported on the supporting platform 14. Proper sealing may be applied to the protection panel 66 so that water vapor or water may be effectively prevented from entering the waterproof section 1132 from the main section 1131.

In this preferred embodiment, the supporting platform 14 may have a substantially U-shaped cross section when viewed from the front as shown in FIG. 3 of the drawings. On the other hand, the protection panel 66 may perpendicularly extend from a horizontal portion 141 of the supporting platform 14.

Referring to FIG. 3 of the drawings, the tank body 21 may further have a receiving recess 217 indently formed on the bottom panel 216 of the tank body 21, wherein the securing housing 15 of the base housing 11 may be accommodated in the receiving recess 217 when the water tank 20 is attached on the base 10. The receiving recess 217 may have a plurality of boundary walls 2171, and a ventilating hole 2172 formed on one of the boundary walls 2171, wherein the ventilating hole 2172 may be arranged to communicate the vapor discharge channel 212 with the vapor discharge outlet 13. Thus, water vapor coming from the vapor discharge outlet 13 may be guided to enter the vapor discharge channel 212 through the ventilating hole 2172.

The operation of the present invention is as follows: a user may first detach the controlling cap 221 from the tank body 21 and fill the storage cavity 211 with a predetermined amount of water. When the water tank 20 is detached from the base 10, the water blocking assembly 61 is closed so that water from ambient environment is prevented from entering the second supporting compartment 113 as described above.

After filling water, the user may then re-attach the controlling cap 221 back to the tank body 21, and put the water tank 20 on the base 10. As mentioned earlier, the actuating member 612 of the water blocking assembly 61 may be actuated to open the vapor discharge outlet 13. At the same time, the engaging member 12 may be arranged to push the sealing member 222 so as to open the water discharge hole 218. After that, water may be discharged to the second water reservoir 115 of the base housing 11. The water may then be guided to enter the first water reservoir 114. A predetermined amount of water in the first water reservoir 114 may be vaporized by the water vaporizer 30 to form water vapor. The water vapor may then be guided to pass through the fan 40 and enter the vapor passage channel 151. Since the water blocking assembly 61 is opened, the water vapor may then be guided to pass through the vapor discharge outlet 13 and eventually enter the vapor discharge channel 212 of the water tank 20. The water vapor may then be discharged out of the humidifier through the vapor discharge opening 214.

From the forgoing descriptions, one skilled in the art may appreciate that PCB 50 and the control circuitry 51 (i.e. electronic components) of the humidifier of the present invention are well-protected through dual safeguards, the first being the water blocking assembly 61, the second being the protection panel 66.

The present invention, while illustrated and described in terms of a preferred embodiment and several alternatives, is not limited to the particular description contained in this specification. Additional alternative or equivalent components could also be used to practice the present invention.

What is claimed is:

1. A humidifier, comprising:

a base comprising a base housing having a receiving cavity and a vapor discharge outlet, said base further comprising a supporting platform mounted in said receiving cavity of said base housing to divide said receiving cavity into a first supporting compartment and a second supporting compartment as separated by said supporting platform;

a water tank which is detachably attached on said base, and comprises a tank body having a storage cavity for storing a predetermined amount of water, and a vapor discharge channel communicated with said vapor discharge outlet a water vaporizer having a vaporizing head provided in said base housing;

a fan provided in said base housing;

a printed circuit board having a control circuitry implemented thereon; and a waterproof arrangement, which comprises a water blocking assembly movably provided in said base housing to selectively cover said vapor discharge outlet of said base housing, said water blocking assembly comprising:

a main blocking member; and an actuating member extended from said main blocking member, wherein when said water tank is attached on said base, said actuating member is driven to drive said water blocking assembly to move away from said vapor discharge outlet so as to allow said vapor discharge outlet to communicate with said vapor discharge channel of said tank body, wherein when said water tank is detached from said base, said actuating member is driven to drive said water blocking assembly to fittedly cover said vapor discharge outlet so as to prevent water from entering said vapor discharge outlet, wherein said base further comprises a securing housing extended on said supporting platform in said first supporting compartment, wherein said vapor discharge outlet is formed as an opening of said securing housing, said water blocking assembly slidably engaging with said securing housing for selectively opening and closing said vapor discharge outlet.

2. The humidifier, as recited in claim 1, wherein said securing housing has a vapor passage channel formed therein, said vapor passage channel communicating with said fan and said water vaporizer so as to constitute a channel for allowing water vapor to pass therethrough, said vapor discharge outlet being formed as an end opening of said vapor passage channel.

3. The humidifier, as recited in claim 2, wherein said waterproof arrangement further comprises a securing member provided on said supporting platform, and a resilient element mounted on said securing member for normally exerting a biasing force against said water blocking assembly so as to normally push said water blocking assembly to block said vapor discharge outlet.

4. The humidifier, as recited in claim 3, wherein said waterproof arrangement further comprises a pushing member provided on said bottom panel of said tank body at a position corresponding to said actuating member of said water blocking assembly so that when said water tank is disposed on said base, said pushing member is arranged to push said actuating member in such a manner to push said water blocking assembly toward said securing member.

5. The humidifier, as recited in claim 4, wherein said actuating member is shaped such that a downward pushing action of said pushing member is arranged to drive said actuating member and said main blocking member to move sidewardly with respect to said securing housing so as to drive said entire water blocking assembly to slide toward said securing member for opening said vapor discharge outlet.

6. The humidifier, as recited in claim 5, wherein said waterproof arrangement further comprises a protection panel extended in said second supporting compartment of said base to divide said second supporting compartment into a main section and a waterproof section, wherein said PCB is accommodated in said waterproof section of said second supporting compartment.

7. The humidifier, as recited in claim 5, wherein said base housing further has a first water reservoir and a second water reservoir formed on said supporting platform in said first supporting compartment, said first water reservoir and said second water reservoir being arranged to store a predetermined amount of water discharging from said water tank, said first water reservoir and said second water reservoir communicating with each other, said vaporizing head of said water vaporizer being provided in said first water reservoir for vaporizing water temporarily stored therein.

8. The humidifier, as recited in claim 6, wherein said base housing further has a first water reservoir and a second water reservoir formed on said supporting platform in said first supporting compartment, said first water reservoir and said second water reservoir being arranged to store a predetermined amount of water discharging from said water tank, said first water reservoir and said second water reservoir communicating with each other, said vaporizing head of said water vaporizer being provided in said first water reservoir for vaporizing water temporarily stored therein.

9. The humidifier, as recited in claim 5, wherein said tank body further has a guiding tube formed in said storage cavity wherein said vapor discharge channel is formed in a space within said guiding tube for allowing water vapor to be discharged out of said humidifier, said tank body further having a vapor discharge opening formed on a top surface, wherein said vapor discharge opening is positioned to correspond to said vapor discharge channel so that said vapor generated by said water vaporizer is arranged to be discharged out of said humidifier through said vapor discharge opening.

10. The humidifier, as recited in claim 7, wherein said tank body further has a guiding tube formed in said storage cavity wherein said vapor discharge channel is formed in a space within said guiding tube for allowing water vapor to be discharged out of said humidifier, said tank body further having a vapor discharge opening formed on a top surface, wherein said vapor discharge opening is positioned to correspond to said vapor discharge channel so that said vapor generated by said water vaporizer is arranged to be discharged out of said humidifier through said vapor discharge opening.

11. The humidifier, as recited in claim 8, wherein said tank body further has a guiding tube formed in said storage cavity wherein said vapor discharge channel is formed in a space within said guiding tube for allowing water vapor to be discharged out of said humidifier, said tank body further having a vapor discharge opening formed on a top surface, wherein said vapor discharge opening is positioned to correspond to said vapor discharge channel so that said vapor generated by said water vaporizer is arranged to be discharged out of said humidifier through said vapor discharge opening.

12. The humidifier, as recited in claim 9, wherein said second water reservoir communicates with said water tank so that said water stored in said water tank is arranged to be guided to enter said second water reservoir when said water tank is attached on said base, water entering said second water reservoir being guided to enter said first water reservoir for vaporization.

13. The humidifier, as recited in claim 10, wherein said second water reservoir communicates with said water tank so that said water stored in said water tank is arranged to be guided to enter said second water reservoir when said water tank is attached on said base, water entering said second water reservoir being guided to enter said first water reservoir for vaporization.

14. The humidifier, as recited in claim 11, wherein said second water reservoir communicates with said water tank so that said water stored in said water tank is arranged to be guided to enter said second water reservoir when said water tank is attached on said base, water entering said second water reservoir being guided to enter said first water reservoir for vaporization.

15. The humidifier, as recited in claim 12, wherein said tank body further has a receiving recess indently formed on said bottom panel of said tank body, wherein said securing housing of said base housing is accommodated in said receiving recess when said water tank is attached on said base, said receiving recess is defined by a plurality of boundary walls one of which has a ventilating hole, said ventilating hole communicating said vapor discharge channel with said vapor discharge outlet.

16. The humidifier, as recited in claim 13, wherein said tank body further has a receiving recess indently formed on said bottom panel of said tank body, wherein said securing housing of said base housing is accommodated in said receiving recess when said water tank is attached on said base, said receiving recess is defined by a plurality of boundary walls one of which has a ventilating hole, said ventilating hole communicating said vapor discharge channel with said vapor discharge outlet.

17. The humidifier, as recited in claim 14, wherein said tank body further has a receiving recess indently formed on said bottom panel of said tank body, wherein said securing housing of said base housing is accommodated in said receiving recess when said water tank is attached on said base, said receiving recess is defined by a plurality of boundary walls one of which has a ventilating hole, said ventilating hole communicating said vapor discharge channel with said vapor discharge outlet.

* * * * *